US007588664B2

(12) United States Patent
Shadid et al.

(10) Patent No.: US 7,588,664 B2
(45) Date of Patent: Sep. 15, 2009

(54) OIL DISTILLATION VACUUM COLUMN WITH THICKENED PLATE IN THE VAPOR HORN SECTION

(75) Inventors: Fahim E. Shadid, Downers Grove, IL (US); Alan W. Green, Plainfield, IL (US)

(73) Assignee: Chicago Bridge & Iron Company, Plainfield, IL (US)

( * ) Notice: Subject to any disclaimer, the term of this patent is extended or adjusted under 35 U.S.C. 154(b) by 627 days.

(21) Appl. No.: 11/190,636

(22) Filed: Jul. 27, 2005

(65) Prior Publication Data

US 2007/0023482 A1 Feb. 1, 2007

(51) Int. Cl.
*B01D 3/10* (2006.01)
*B23K 20/08* (2006.01)

(52) U.S. Cl. ..... 196/114; 196/133; 196/155; 202/205; 202/267.1; 228/107; 228/175

(58) Field of Classification Search ..... 196/46, 196/114, 133, 155; 202/205, 267.1; 228/57, 228/107, 175
See application file for complete search history.

(56) References Cited

U.S. PATENT DOCUMENTS 3,929,537 A * 12/1975 Erwin ..... 156/86
4,272,005 A * 6/1981 Jackson et al. ..... 228/107

* cited by examiner

*Primary Examiner*—Virginia Manoharan
(74) *Attorney, Agent, or Firm*—Marshall, Gerstein & Borun LLP

(57) ABSTRACT

A vacuum column for oil distillation incorporates a thickened plate that has a layer of erosion-resistant material that is thicker than the corrosion-resistant thickness of an adjacent column section. Use of thickened, explosive- or roll-bonded clad plates may provide better service than either conventional plug-welded liners or conventional shell plates with weld overlays.

11 Claims, 4 Drawing Sheets

OIL DISTILLATION VACUUM COLUMN WITH THICKENED PLATE IN THE VAPOR HORN SECTION

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

The present invention relates generally to vacuum columns used in oil distillation, and more particularly to the problem of erosion in the vapor horn section of the column.

In petroleum refining, a vacuum column is used to distill feed stock at reduced pressure and high temperature to recover additional distillates (such as vacuum gas oils, lubricating oils, and/or conversion feedstocks) from reduced crude, which is the bottoms product of an atmospheric distillation unit.

The feed from an atmospheric distillation unit enters a "vapor horn" section of the vacuum column through a feed inlet. The feed inlet can be either tangential or radial. An internal box or tangential distributor assists in dispersing the feed. In general, the temperature in the vapor horn section may approach 800° F. (420° C.) at a pressure in the range of about 7.5 to 14.7 psig external pressure.

Conventionally, the shell of the vacuum column in this section of the column is protected against erosion by a stainless steel liner plate attached to the inside of the vessel. The liner plate may be about 6 feet high and commonly subtends around 270 degrees of the circumference of the column.

The liner plate generally is welded to the shell of the vacuum column at the perimeter of the liner plate. The shell of the vacuum column is usually composed of clad plates that each have a stainless steel clad interior surface (up to ⅛" thick or so for conosion resistance) on a carbon steel backing plate. Generally, the liner plate is perimeter welded to the carbon steel backing plate after stripping sections of the stainless steel clad interior surface from the backing plate. To provide an adequate bond between the liner plate and the shell of the vacuum column, the liner plate is also commonly plug welded to the shell at about 12" to 15" intervals. The plug welds are commonly welded directly to the stainless steel cladding on the shell plates.

The installation of such liners is time-consuming and costly. Further, cracks can develop at the plug weld locations, requiring expensive downtime to repair and replace the liner plate.

Another known procedure for providing additional erosion resistance in the vapor horn section of a vacuum column involves adding a weld overlay to the inside surface of the column in that section. This procedure is generally viewed as uneconomical, and could cause local shrinkage or distortion.

BRIEF SUMMARY OF THE INVENTION

The inventors have developed an oil distillation vacuum column that can provide improved erosion resistance without the use of a liner plate or a weld overlay. A thickened clad plate is used when constructing the vapor horn section of the shell. The thickened clad plate has a layer of cladding that is thicker than the corrosion-resistant thickness of the adjacent column section. Because the layer of thicker cladding is continuously bonded to a backing plate, it is believed that the thickened clad plate will function better than either conventional added wear plates or weld overlays, with reduced likelihood of cracks.

BRIEF DESCRIPTION OF THE DRAWINGS

The invention may be better understood by referring to the accompanying drawings, in which.

DETAILED DESCRIPTION OF THE INVENTION

Figure 1:
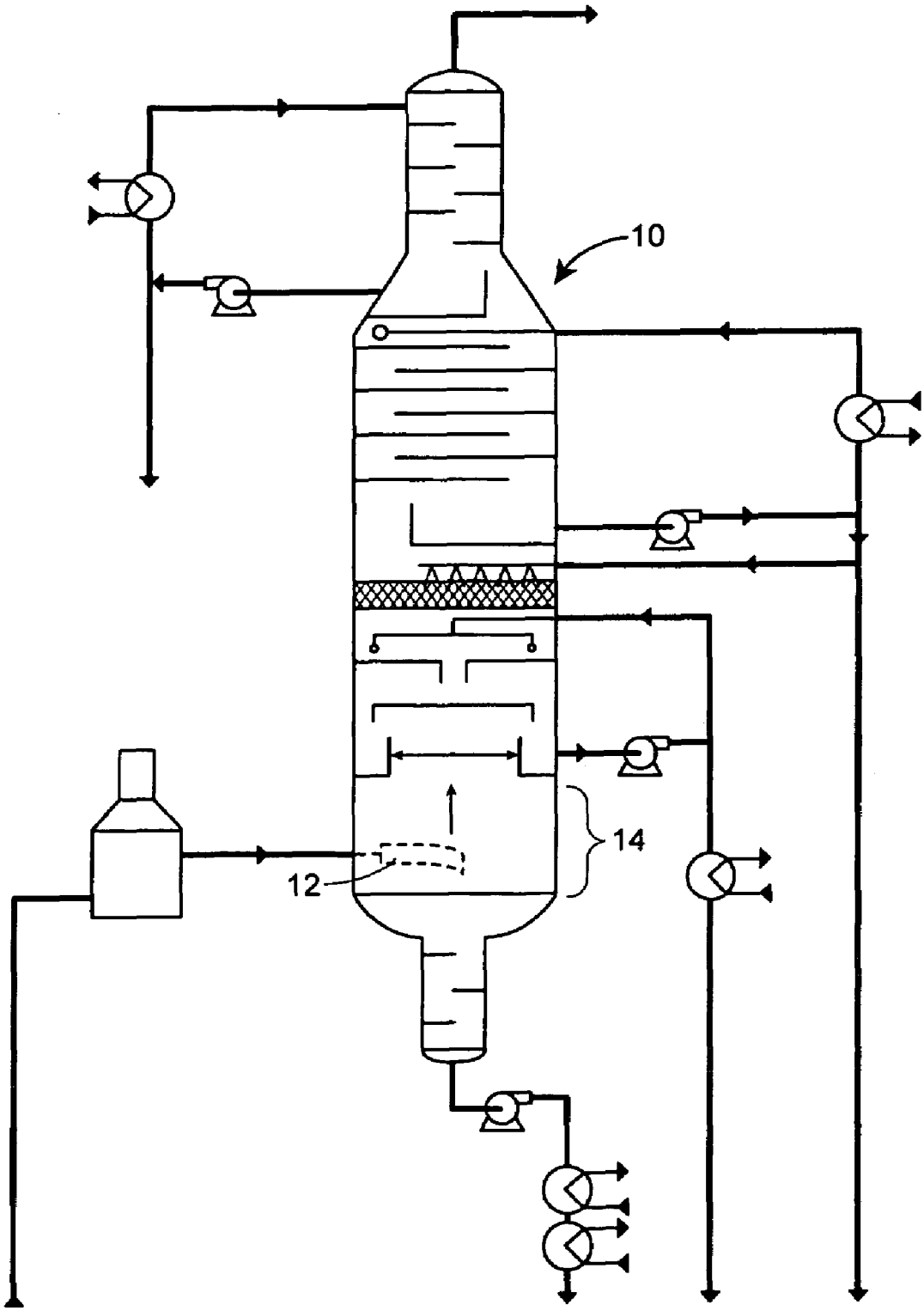
FIG. 1 is a schematic view of a vacuum column.

FIG. 1 generally illustrates a vacuum column 10 used in oil distillation. Heated feed is introduced to the vacuum column through a feed inlet 12, entering a vapor horn section 14 of the column. In the vapor horn section, vapor and liquid are separated. In the illustrated vacuum column, the temperature in the vapor horn section may approach 420° C., and the pressure can be in the order of about 7.5 to 14.7 psig external pressure to obtain a desirable distillate yield.

Figure 2:
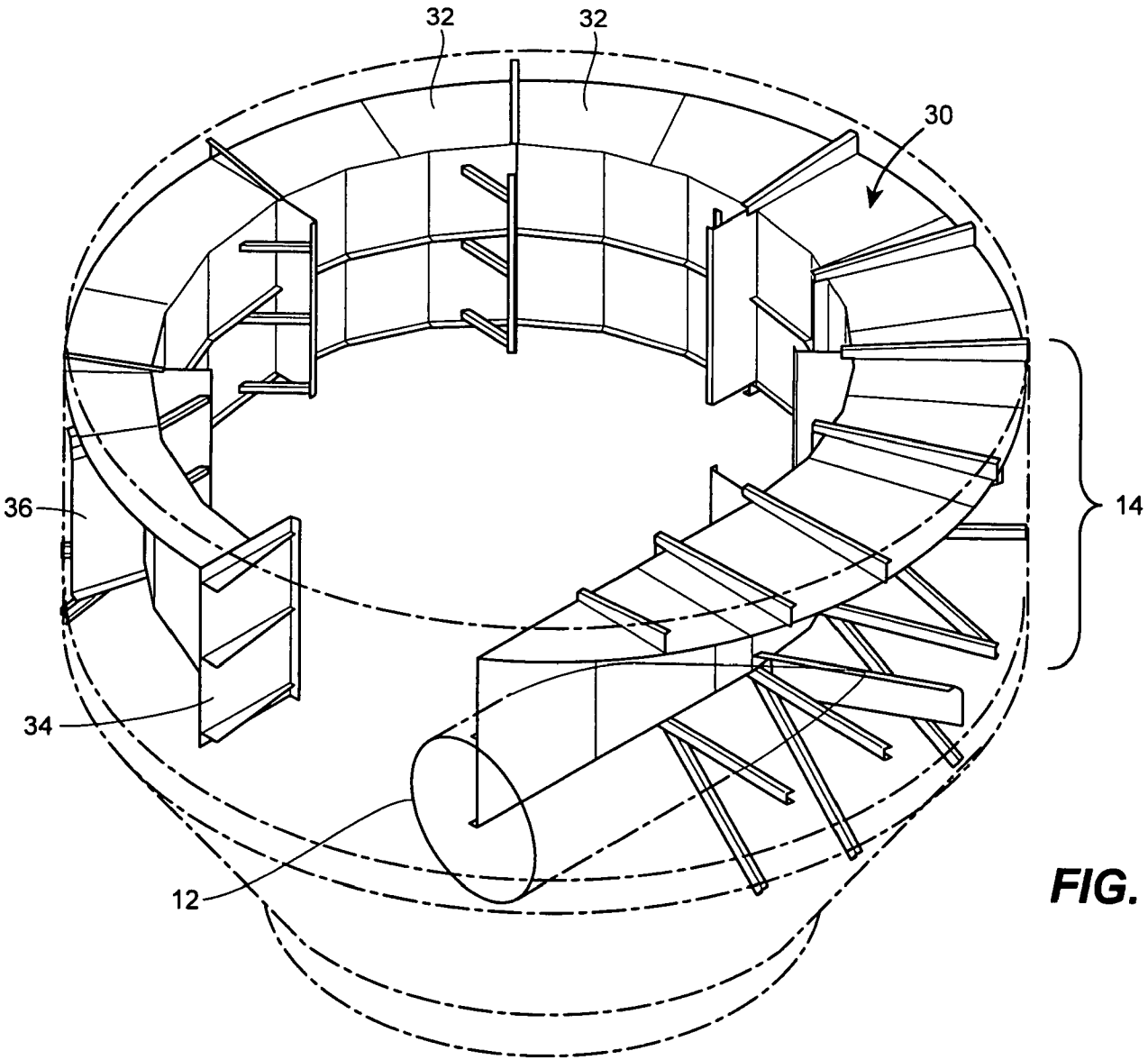
FIGS. 2 and 3 are cut-away perspective views of the vapor horn section of two related embodiments of vacuum columns in accordance with the present invention.
Figure 3:
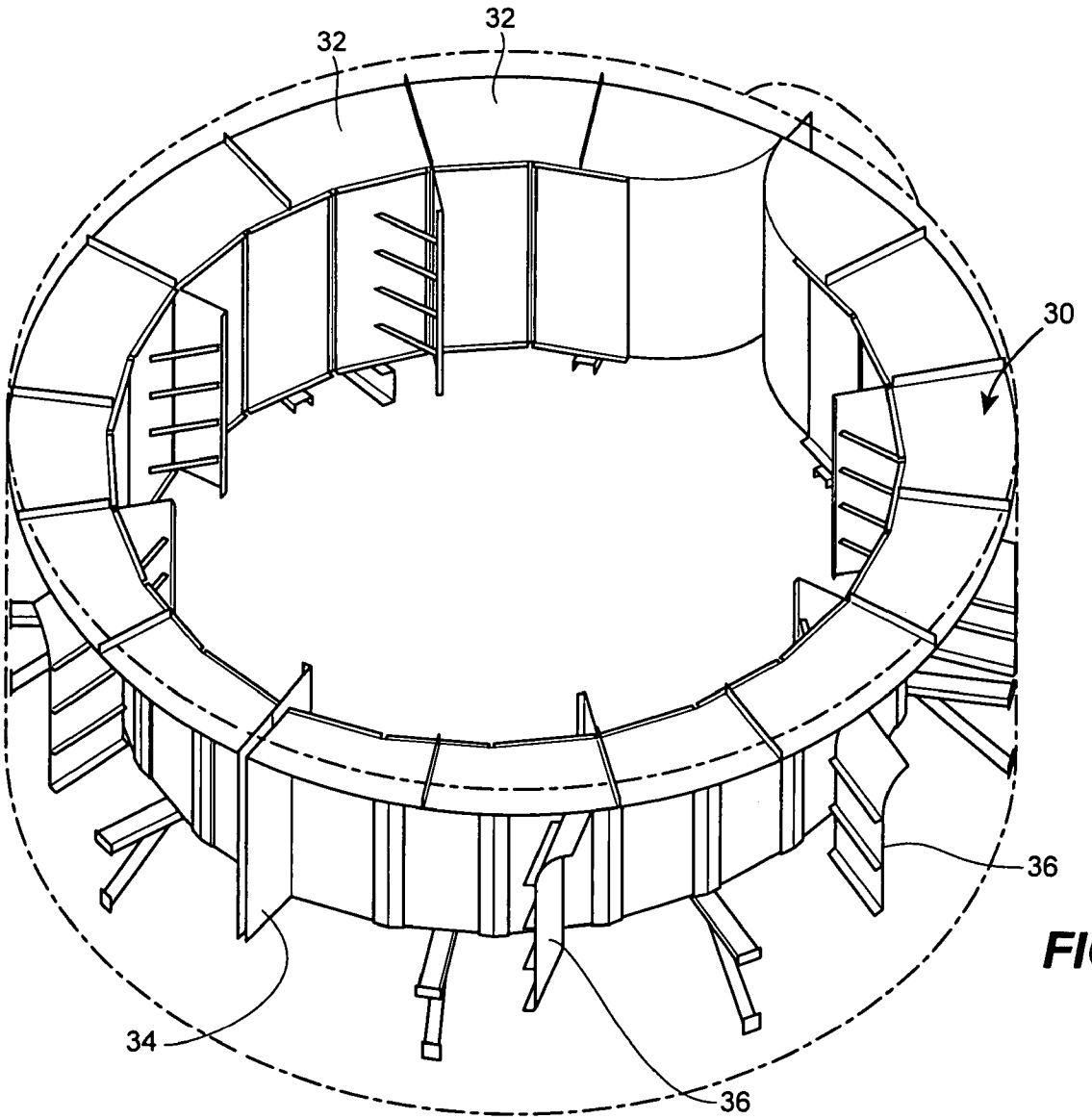

FIGS. 2 and 3 illustrate the structure of the column 10 in the vapor horn section 14, showing the feed inlet 12 and a distributor 30. The feed inlet is arranged to distribute feed across plates that form the vapor horn section of the column. The feed inlet may be tangential, as seen in FIG. 2, or radial, as seen in FIG. 3. The distributor, which is generally installed after the shell of the column is erected, can include a series of top plates 32 and an end plate 34 that are all welded to the shell of the column. The illustrated distributors also include a series of deflector vanes 36 that can disperse vacuum gas oils while directing a heavier fraction of the feed toward the bottom of the column.

Figure 4:
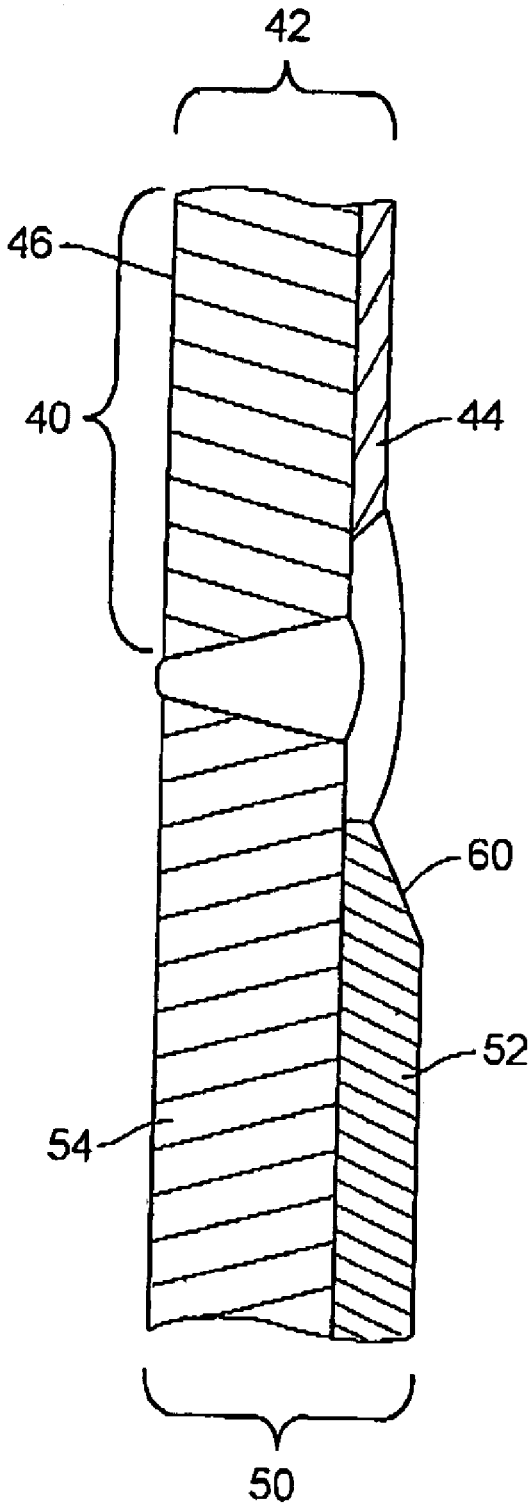
FIG. 4 is an enlarged cross-sectional view of a portion of the structures seen in FIGS. 2 and 3.

As seen in FIG. 4, the illustrated column 10 has a column section that is made with a conventional clad plate 42 that has a stainless steel clad interior surface 44 on a carbon steel backing plate 46. The illustrated backing plate has a backing plate thickness of, for example, about 1 inch. The illustrated stainless steel clad interior surface is ⅛" thick. This corrosion-resistant thickness can be varied, and generally corresponds with a project specification.

In the vapor horn section 14, where the feed inlet 12 distributes feed across the exposed inner surface of plates of the column, the illustrated column 10 is fabricated from a thickened clad plate 50 that includes a layer of thickened cladding 52 on a carbon steel backing plate 54. Preferably, the backing plate on the thickened clad plate is about the same thickness as the backing plate 46 on the clad plate 42 used in the adjacent column section 40, while the layer of cladding on the thickened clad plate—which forms the exposed inner surface of the vapor horn section—is significantly thicker than the clad interior surface 44 on the adjacent clad plate. The overall thickness of the thickened clad plate is greater than the combined thickness of the backing plate and the clad interior surface on the conventional clad plate. In cases where an additional erosion-resistant thickness has been specifically called out for the vapor horn section 14, the overall thickness of the layer of thicker cladding may, for example, be the sum of the corrosion-resistant thickness used on the adjacent column section and the specified erosion-resistant thickness for the vapor horn section.

As illustrated, the layer of cladding 52 on the thickened clad plate 50 is at least around ¼ inches thick. In the illustrations, the cladding is about ½ inches thick. Preferably, the thickened clad plate is prefabricated, with the cladding being either roll-bonded (if the cladding thickness is less than or equal to about ⅜") or explosive-bonded (for cladding thicknesses exceeding ⅜") to a carbon-steel inside face on the backing plate 54. Explosive bonding, while more expensive, provides better shear strength between the backing plate and the cladding (on the order of 65 ksi for explosive bonding, versus on the order of 20 to 35 ksi for roll bonding). Ultrasonic testing may be done to assure that there is a good bond between the stainless steel cladding and the backing plate.

A beveled edge 60 on the layer of cladding 52 on the thickened clad plate 50 may facilitate the connection of the thickened clad plate to the adjoining column section 40 during erection of the column 10. In the illustrations, the edges of the cladding on the thickened clad plate are beveled down to the thickness of the edges on the adjacent column section. This arrangement facilitates the butt-welding of the edges of the thickened clad plate into the shell of the column during erection.

This description of various embodiments of the invention has been provided for illustrative purposes. Revisions or modifications may be apparent to those of ordinary skill in the art without departing from the invention. The full scope of the invention is set forth in the following claims.

What is claimed is:

1. An oil distillation vacuum column comprising:

a first column section that has a layer of cladding of a given thickness;

an adjacent vapor horn section of the column that has a thickened clad plate that has a layer of cladding that is thicker than the cladding in the first column section; and a feed inlet arranged to distribute feed across the thickened clad plate.

2. An oil distillation vacuum column as recited in claim 1, in which the layer of cladding on the thickened clad plate is bonded to a backing plate that has an inside face made of carbon steel.

3. An oil distillation vacuum column as recited in claim 1, in which the layer of cladding on the thickened clad plate is explosive-bonded to a backing plate.

4. An oil distillation vacuum column as recited in claim 1, in which the layer of cladding on the thickened clad plate is roll-bonded to a backing plate.

5. An oil distillation vacuum column as recited in claim 1, in which the layer of cladding on the thickened clad plate is bonded to a backing plate that has a thickness that is approximately equal to the thickness of a backing plate in the first column section.

6. An oil distillation vacuum column as recited in claim 1, in which the layer of cladding on the thickened clad plate is at least ¼ inch in thickness

7. An oil distillation vacuum column as recited in claim 1, in which the layer of cladding on the thickened clad plate forms the exposed inner surface of the vapor horn section of the column.

8. An oil distillation vacuum column as recited in claim 1, in which the thickened clad plate subtends at least around 90 degrees of the column.

9. An oil distillation vacuum column as recited in claim 1, in which the thickened clad plate subtends at least around 180 degrees of the column.

10. A thickened clad plate for the vacuum column recited in claim 1.

11. An oil distillation vacuum column as recited in claim 1, in which the cladding on the thickened clad plate exceeds ⅜" in thickness.

* * * * *

UNITED STATES PATENT AND TRADEMARK OFFICE

CERTIFICATE OF CORRECTION

PATENT NO. : 7,588,664 B2
APPLICATION NO. : 11/190636
DATED : September 15, 2009
INVENTOR(S) : Shadid et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1040 days.

Signed and Sealed this

Twenty-first Day of September, 2010

David J. Kappos

David J. Kappos
*Director of the United States Patent and Trademark Office*